US006974227B2

(12) United States Patent
Tsai

(10) Patent No.: US 6,974,227 B2
(45) Date of Patent: Dec. 13, 2005

(54) SUPPORTING STRUCTURE FOR CHRISTMAS LIGHT DECORATION

(76) Inventor: Hung-Chi Tsai, No. 40, Sec. 2, Chung-Hua Rd., Hsinchu City (TW)

( * ) Notice: Subject to any disclaimer, the term of this patent is extended or adjusted under 35 U.S.C. 154(b) by 101 days.

(21) Appl. No.: 10/229,419

(22) Filed: Aug. 27, 2002

(65) Prior Publication Data

US 2005/0248943 A1 Nov. 10, 2005

(51) Int. Cl.[7] ..... F21V 21/00
(52) U.S. Cl. ..... 362/123; 362/249; 362/806
(58) Field of Search ..... 362/102, 123, 362/249, 250, 252, 285, 287, 396, 418, 431, 806

(56) References Cited

U.S. PATENT DOCUMENTS 3,970,834 A * 7/1976 Smith ..... 362/123
6,439,249 B1 * 8/2002 Pan et al. ..... 362/102
6,499,856 B2 * 12/2002 Lee ..... 362/249

* cited by examiner

*Primary Examiner*—Y. My Quach-Lee
(74) *Attorney, Agent, or Firm*—Egbert Law Offices

(57) ABSTRACT

The present invention is a supporting structure for decorative Christmas lights. The main structure of the present invention is a center pole with a fixed hub at the top, and a movable hub, which can move along the center pole. A plurality of hanging bars are connected to the fixed hub at one end, and connected to the supportive struts at the other end. The other ends of the supportive struts are hooked to the movable hub. This forms an umbrella-like structure. By moving the movable hub along the center pole, the structure can be easily opened up or display or fold to save storage space. It could also form a multi-level structure and a number of variations. The lights can be hanged, or clipped to the structure. When the structure is implemented with hollow tubes, the lights can be inserted inside the tubes. The different styles of attaching lights to the supporting structure can be combined to achieve various desirable visual effects.

4 Claims, 9 Drawing Sheets

SUPPORTING STRUCTURE FOR CHRISTMAS LIGHT DECORATION

FIELD OF THE INVENTION

This invention relates to a supporting structure for Christmas light decoration, and more particularly to a new supporting structure easy for folding and storage.

BACKGROUND OF THE INVENTION

As people pay more and more attention to holiday celebration, it is easy to see decorative lights everywhere during the holidays. One of the most popular styles among those is an artificial Christmas tree decorated with colorful small lights. However, the present design of the artificial Christmas trees is usually bulky, and difficult for storage. Hence, it is prone to damage during the transportation and storage.

The present invention is a foldable supporting structure for decorative Christmas lights. It is easy to set up and fold, and suitable for transportation and storage.

SUMMARY OF THE INVENTION

The present invention is a supporting structure, for decorative Christmas lights. It uses a multi-level structure to form a number of variations. The lights can be hanged, or clipped to the structure. Alternatively, when the structure is implemented with hollow tubes, the lights can be inserted inside the tubes. The different styles of attaching lights to the supporting structure can be combined to achieve various desirable visual effects.

The main structure of the present invention is the center pole with a fixed hub at the top, and a movable hub, which can move along the center pole. A plurality of hanging bars are connected to the fixed hub at one end, and connected to the supportive struts at the other end. The other ends of the supportive struts, are hooked to the movable hub. This forms an umbrella-like structure. A component is used to attach the hanging bar to the fixed hub, and another component to attach the supportive strut to the movable hub. A joint component used to connect the hanging bar and the supportive struts are foldable. Both the hanging bars and the supportive struts can be made If tubes so that the lights can be inserted inside the tubes. By moving the movable hub along the center pole, the structure can be easily opened up or display or fold to save storage space.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
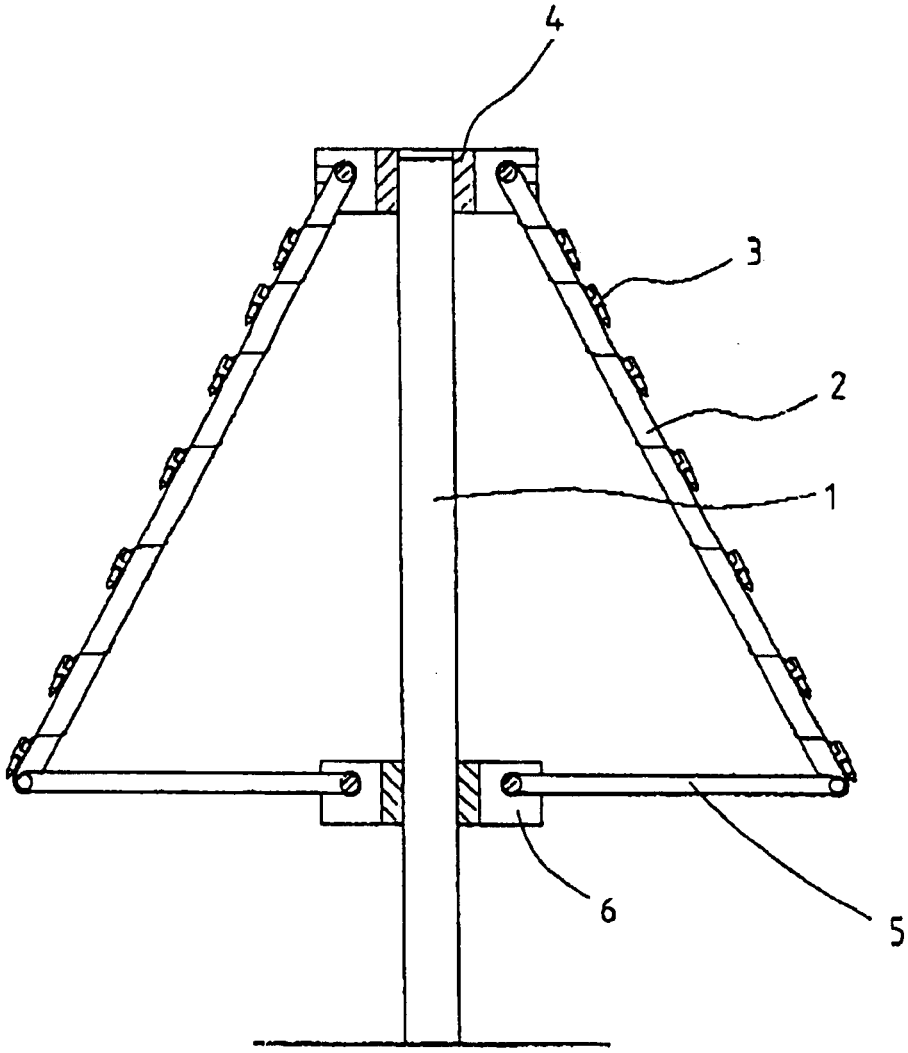
FIG. 1 shows the side view of the present invention.

FIG. 1 shows the side view of the present invention, including a center pole 1, hanging bars 2. Lights 3 are hanging around hanging bars 2. On the center pole 1, there is a fixed hub 4, whose rim is connected to a plurality of hanging bars 2. The other ends of the hanging bars 2 are connected to the supportive struts 5, whose other ends are connected to a movable hub 6, which can move along the center pole 1.

Figure 2:
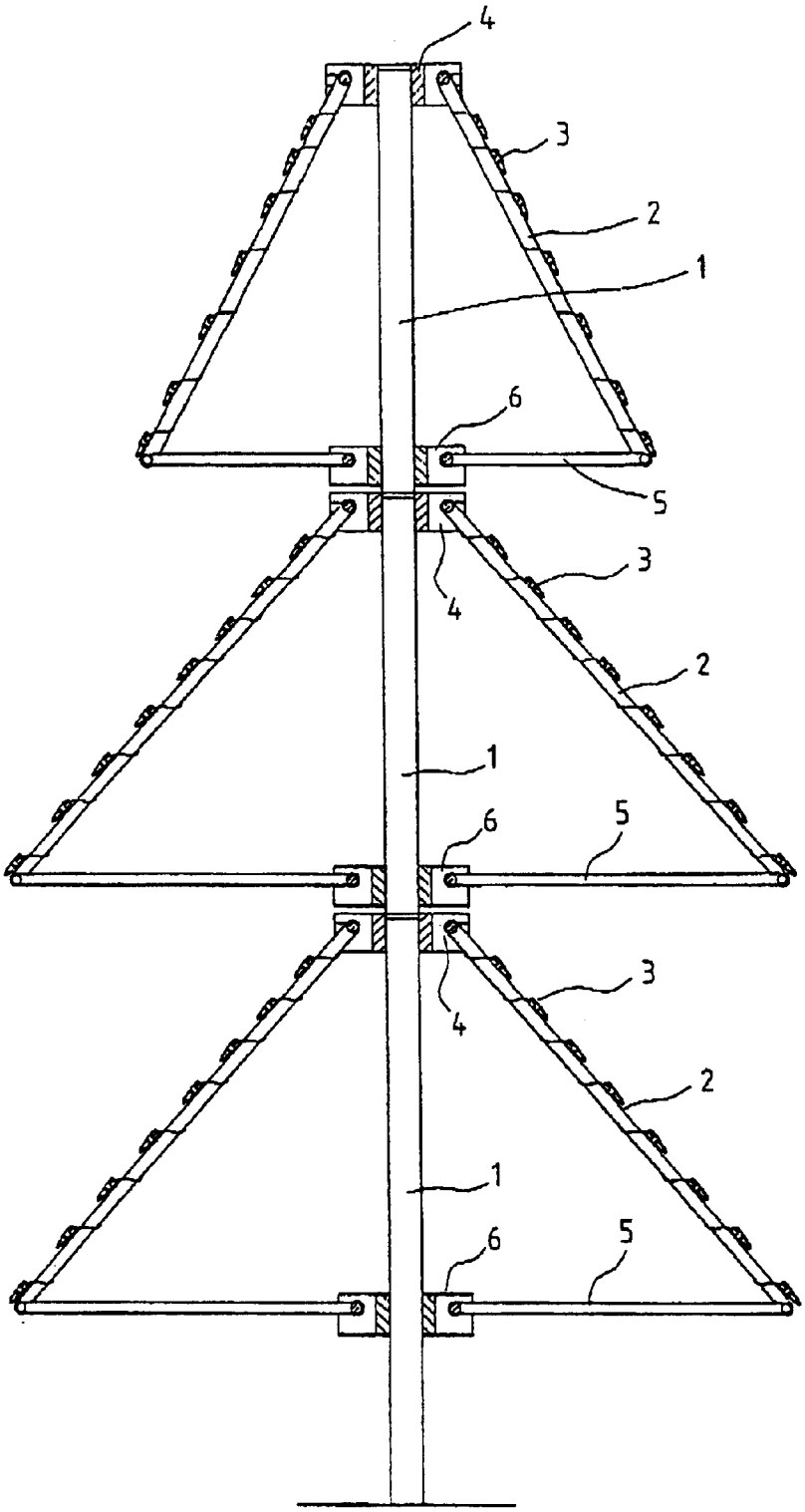
FIG. 2 shows the embodiment of a multi-level structure of the present invention.

FIG. 2 shows the embodiment of a multi-level structure of the present invention. By moving the movable hub 6 downward along the center pole 1, the supportive struts 5 extends horizontally to open up the hanging bars 2 into an umbrella-like form. By using multi-level structure, the present invention shows a shape of a Christmas tree. When the lights 3 are lit, a colorful Christmas tree lights is displayed.

Figure 3:
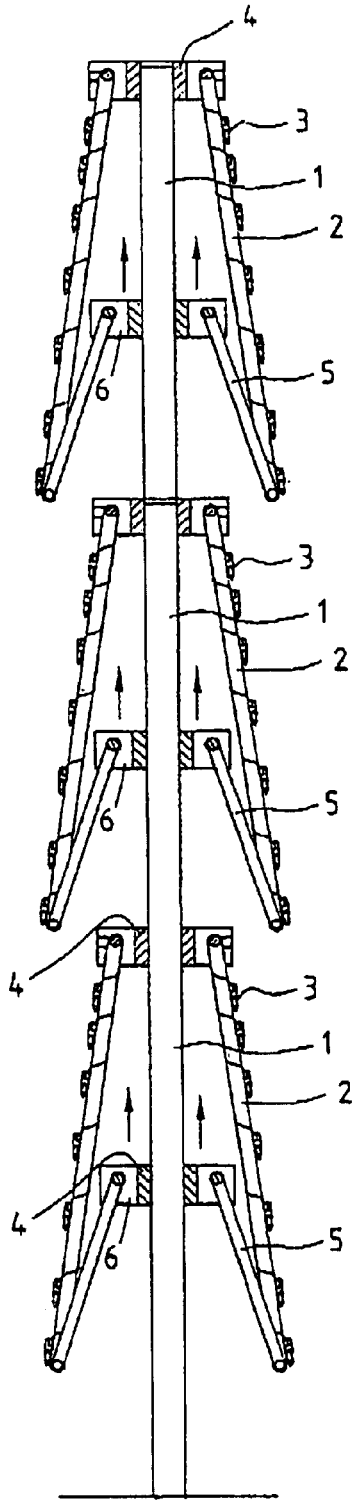
FIG. 3 shows the side view when the present invention is folded.

FIG. 3. shows diagram when the multi-level structure is unfolded. By moving the movable hub 6 upward along the center pole 1, supportive struts 5 retreat into the upright position and the hanging bars 2.are pulled towards the center pole 1. It is like unfolding an umbrella. The unfolded structure is easy for transportation and storage.

Figure 4:
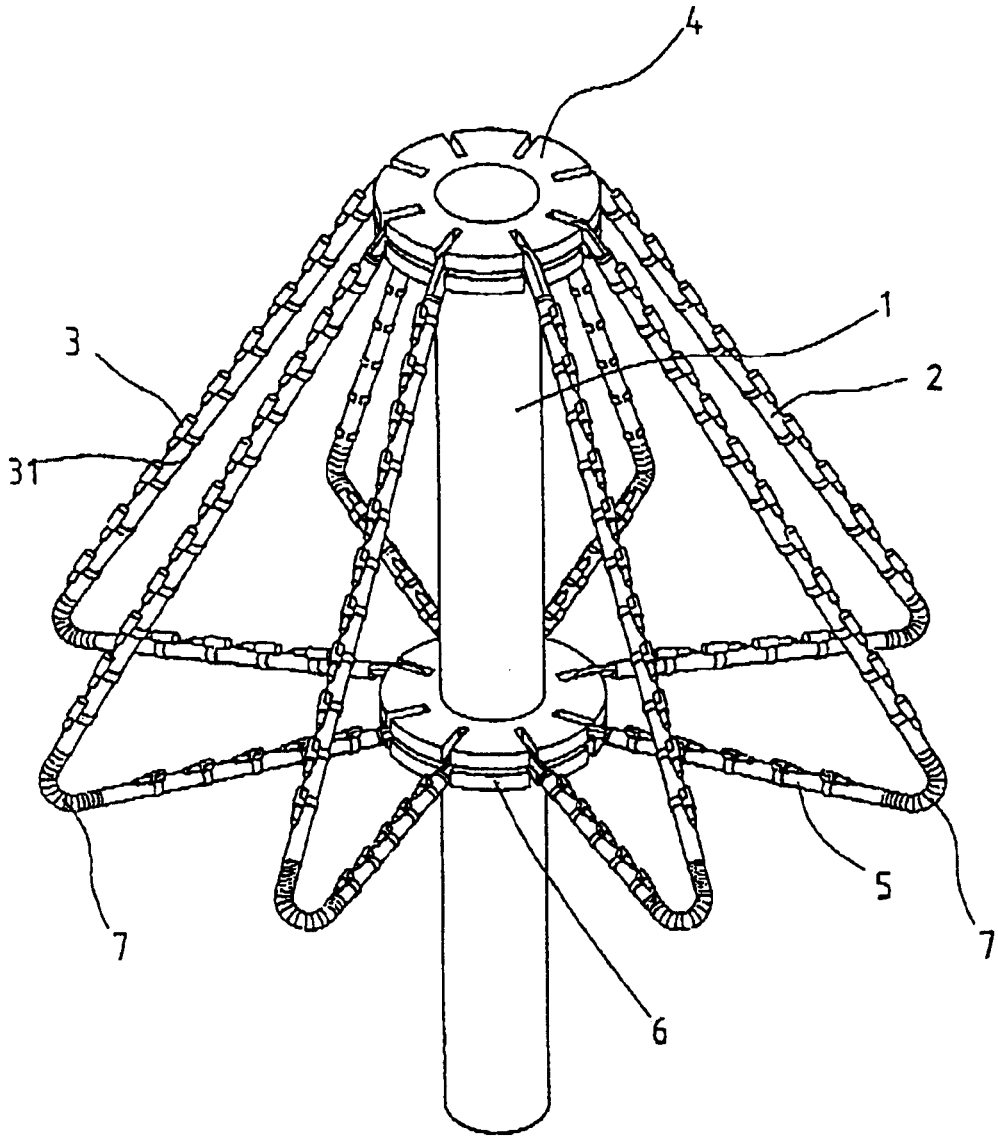
FIG. 4 shows a second embodiment of the present invention.

FIG. 4 shows a second embodiment of the present invention. The embodiment uses a flexible spring 7 as a connecting component between the hanging bar 2 and the supportive struts 5. A plurality of clips 31 are constructed along the hanging bars 2 and supportive struts 5 for clipping the lights 3. By moving the movable hub 6, the structure can be opened for display or folded to save space.

Figure 5:
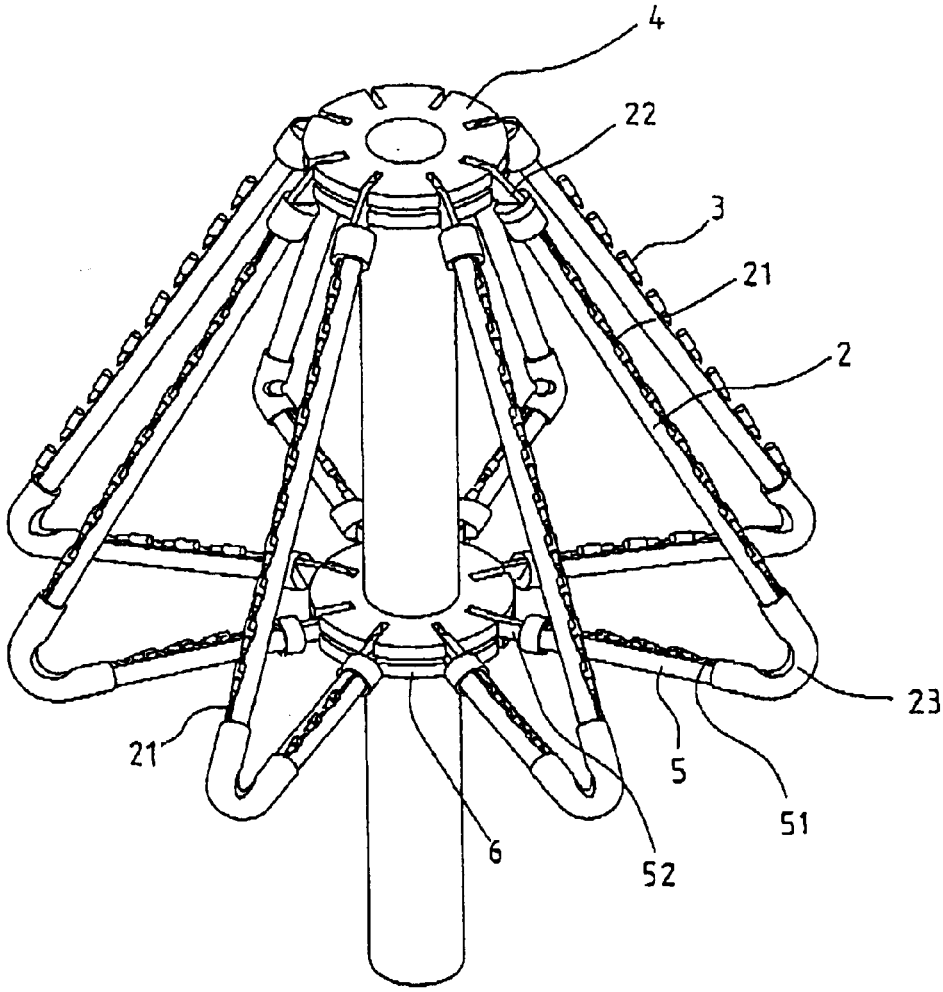
FIG. 5 shows a third embodiment of the present invention, wherein the bars and the struts being made of tubes.
Figure 6:
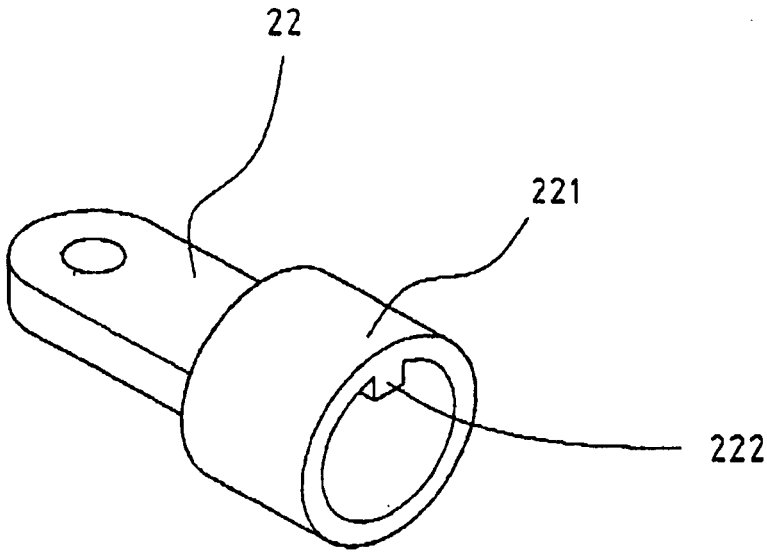
FIG. 6 shows the attaching components used in the FIG. 5.
Figure 7:
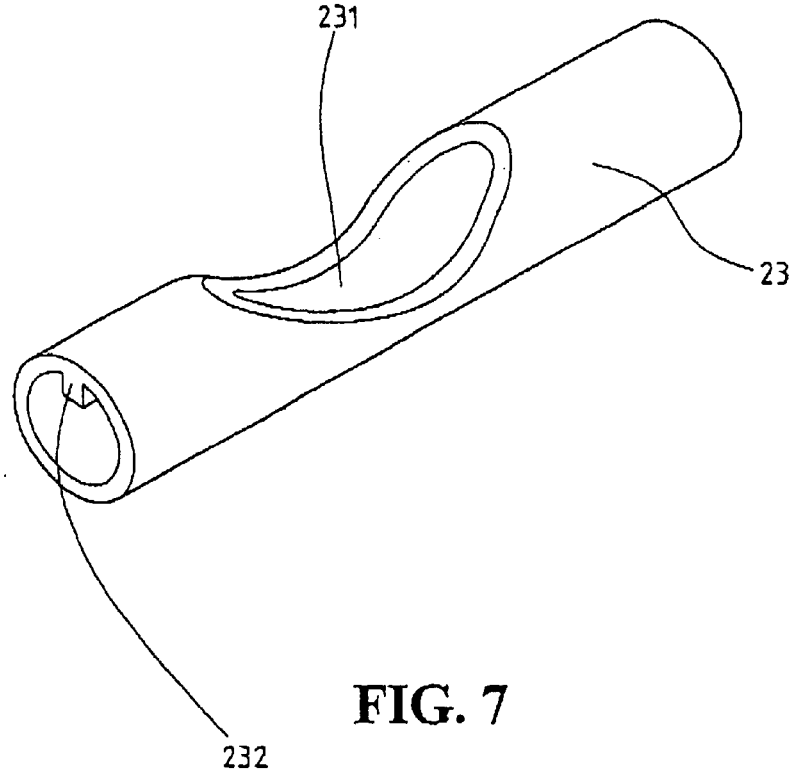
FIG. 7 shows the joint components used to joint the hanging bar and supportive strut in FIG. 5.
Figure 8A:
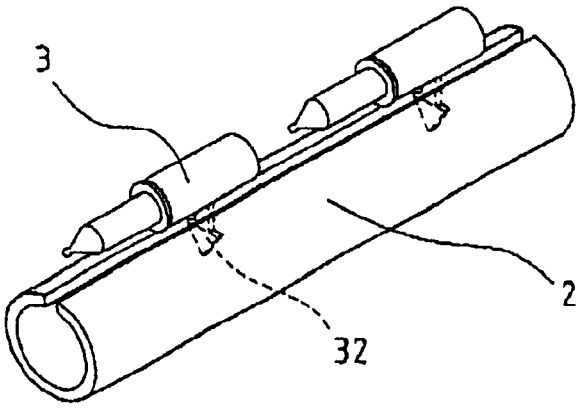
FIG. 8A shows the enlarged diagram of lights clipped to the supportive struts.

FIG. 5 shows a third embodiment of the present invention. The embodiment uses hollow tubes to construct the hanging bars 2 and the supportive struts 5. The tubes can be transparent, opaque, or translucent with color. A small gap 21, 51 is opened on the tubes to fix the lights 3. A small triangular bump 32 (shown in FIGS. 8A, 8B) on the light 3 is used for clipping the lights to the gap 21, 51 on the tube. An attachment component 22 (shown in FIG. 6) is constructed to connect the hanging bar 2 to the fixed hub 4. The attachment component 22 includes a tube part 221, inside which is a square bump 222. The attachment component 22 is connected to the fixed hub at one end, and the tube part 221 of the attachment component 22 is used to hold the hanging bars 2, and the square bump 222 is inserted between the gap 21 to hold the hanging bars 2 in position. The other end of the hanging bar 2 is connected by a flexible component 23 (shown in FIGS. 5, 7) to a supportive strut 5. An opening 231 is constructed on the component 23 for easy bending, and a square bump 232 is also constructed inside both ends of the, component 23. The position of the square bumps 232 in each end of the component 23 depends on the relative position of the hanging bars 2 and the supportive struts 5. A gap 51 is also constructed on the supportive struts 5 to hold the lights 3 in position. The supportive strut 5 is connected to the movable hub 6 by an attachment component 52, which is identical to the attachment component 22. The hanging bar 2 and supportive strut 5 can be disassembled from the structure by detaching the attachment components 22, 52. The design for easy assembly and disassembly can further reduce the volume for the convenience of transportation and storage.

Figure 8B:
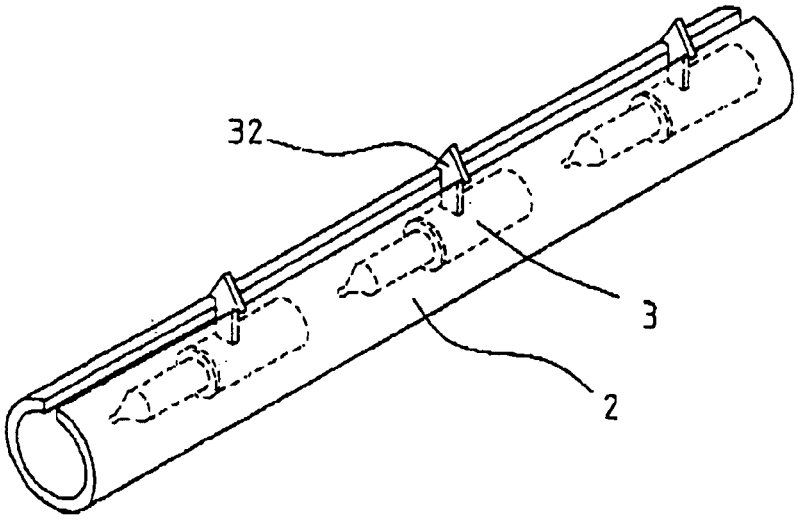
FIG. 8B shows the enlarged diagram of another embodiment of the lights clipped to the supportive struts.
Figure 9:
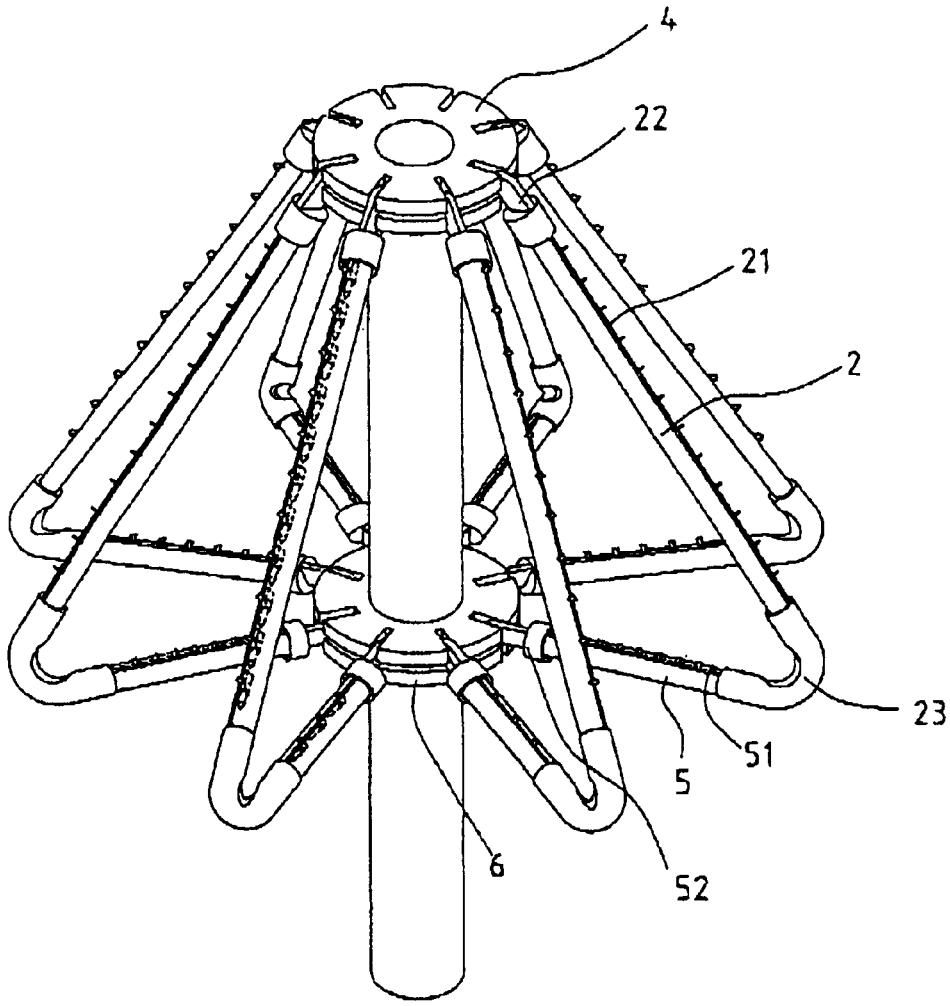
FIG. 9 shows the embodiment of the lights being inserted inside the supportive struts.

FIG. 8B shows how the triangular bump 32 on the lights 3 is clipped outside of the hanging bar 2 or supportive strut 5, so that the lights 3 are hidden inside the tube. In this embodiment, the tubes must be transparent or translucent to create another desirable visual effects, as shown in FIG. 9.

While we have shown and described the embodiment in accordance with the present invention, it should be clear to those skilled in the art that further embodiments may be made without departing from the scope of the present invention.

What is claimed is:

1. A supporting structure for Christmas lights comprising:

a center pole;

a fixed hub secured to said center pole;

a plurality of first attachment components affixed to a periphery of said fixed hub;

a plurality of hanging bars respectively attached to said plurality of first attachment components, said plurality of hanging bars hanging from said fixed hub;

a plurality of supportive struts respectively connected at one end to said plurality of hanging bars by a flexible connecting component;

a movable hub extending around and movable along said center pole;

a plurality of second attachment components affixed to a periphery of said movable hub, said plurality of supportive struts respectively attached at an opposite end to said plurality of second attachment components; and a plurality of lights being hanged or clipped onto said plurality of hanging bars, said plurality of hanging bars and said plurality of supportive struts each being formed of a hollow tube with an opening gap formed through a wall thereof, each of said plurality of lights having a triangular bump extending therefrom, said triangular bump clipping into said opening gap so as to fix the light thereto.

2. The supporting structure of claim 1, said flexible connecting component being a flexible spring.

3. A supporting structure for Christmas lights comprising:

a center pole;

a fixed hub secured to said center pole;

a plurality of first attachment components affixed to a periphery of said fixed hub;

a plurality of hanging bars respectively attached to said plurality of first attachment components, said plurality of hanging bars hanging from said fixed hub;

a plurality of supportive struts respectively connected at one end to said plurality of hanging bars by a flexible connecting component;

a movable hub extending around and movable along said center pole;

a plurality of second attachment components affixed to a periphery of said movable hub, said plurality of supportive struts respectively attached at an opposite end to said plurality of second attachment components, each of said first and second attachment components being a tubular part with a square bump formed therein; and a plurality of lights being hanged or clipped onto said plurality of hanging bars, said plurality of hanging bars and said plurality of supportive struts each being formed of a hollow tube with an opening gap formed through a wall thereof, said tubular part respectively receiving the hollow tube therein with said square bump clipped into said opening gap.

4. A supporting structure for Christmas lights comprising:

a center pole;

a fixed hub secured to said center pole;

a plurality of first attachment components affixed to a periphery of said fixed hub;

a plurality of hanging bars respectively attached to said plurality of first attachment components, said plurality of hanging bars hanging from said fixed hub;

a plurality of supportive struts respectively connected at one end to said plurality of hanging bars by a flexible connecting component;

a movable hub extending around and movable along said center pole;

a plurality of second attachment components affixed to a periphery of said movable hub, said plurality of supportive struts respectively attached at an opposite end to said plurality of second attachment components, said flexible connecting component having an open area formed therein; and a plurality of lights being hanged or clipped onto said plurality of hanging bars, said plurality of hanging bars and said plurality of supportive struts each being formed of a hollow tube with an opening gap formed through a wall thereof, each end of said flexible connecting component having a square bump formed therein, said square bump being clipped into said opening gap of a respective hanging bar of said plurality of hanging bars and a respective supportive strut of said plurality of supportive struts.

* * * * *